US005529308A

United States Patent [19]

Masakayan

[11] Patent Number: 5,529,308

[45] Date of Patent: Jun. 25, 1996

[54] GOOD NEWS BIBLE BOARD GAME

[76] Inventor: Jose Masakayan, 8611 Eagle Glen Ter., Fairfax Station, Va. 22039

[21] Appl. No.: 489,649

[22] Filed: Jun. 12, 1995

[51] Int. Cl.[6] ..... A63F 9/18; A63F 3/00

[52] U.S. Cl. ..... 273/243; 273/431; 434/245

[58] Field of Search ..... 273/243, 248, 273/246, 249, 250–254

[56] References Cited

U.S. PATENT DOCUMENTS

| | | | |
|---|---|---|---|
| 1,148,737 | 9/1915 | Atkins | 273/246 |
| 1,391,333 | 9/1921 | McManus | 273/249 |
| 4,121,823 | 10/1978 | McBride | 273/249 |
| 4,201,388 | 5/1980 | Cantelon | 273/251 |
| 4,448,421 | 5/1984 | Zaruba et al. | 273/243 |
| 4,779,875 | 10/1988 | Sypal | 273/253 |
| 4,934,709 | 6/1990 | Peterson | 273/249 |
| 5,042,816 | 8/1991 | Davis et al. | 273/243 |
| 5,071,133 | 12/1991 | Smith | 273/248 |
| 5,092,606 | 3/1992 | Miller | 273/249 |
| 5,152,535 | 10/1992 | Roberts | 273/249 |
| 5,224,862 | 7/1993 | Sullivan | 434/129 |
| 5,295,834 | 3/1994 | Saunders | 434/128 |
| 5,377,991 | 1/1995 | Olsen | 273/249 |

*Primary Examiner*—Benjamin H. Layno
*Attorney, Agent, or Firm*—Tom Hamill, Jr.

[57] ABSTRACT

An instructional board game is provided which teaches spiritual principles as disclosed in the Bible to players of all ages. The game is designed to be an interactive multi-player game which includes a board, player tokens, various collectable items, dice, cards and a timer. The board includes a sequential pattern of rectangles which the players would move their tokens in response to a throw of the dice. The sequential pattern generally resembles a tree. The player will transit the board following the sequential pattern with the object of gathering "fruit", living a principled Christian life, avoiding Sin, and responding correctly to questions posed when the player lands the interactive squares. The game simulates a players journey through Christian life, with all joys, trials and tribulations therein, concluding with the timer signal which announces Christ's Second Coming. Christ's Second Coming denotes the end of the game, the player or players who have gathered the most fruit through their game life and have had their names entered in the "Book of Life" satisfy the winning conditions and thus go to Heaven. The instant game may be suitable for electronic gaming as well, that is, a computer game utilizing the method and layout may be provided.

12 Claims, 3 Drawing Sheets

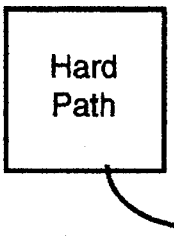
Figure 2A
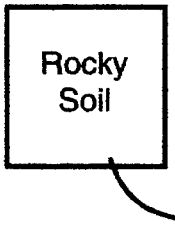
Figure 2B
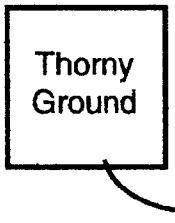
Figure 2C
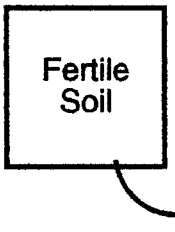
Figure 2D
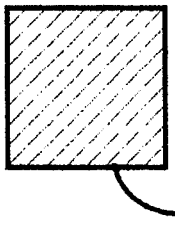
Figure 2E
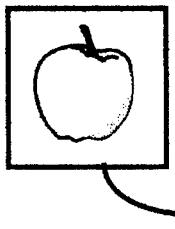
Figure 2F
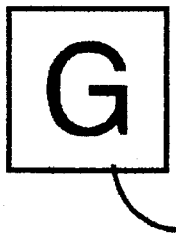
Figure 2G
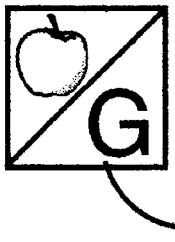
Figure 2H
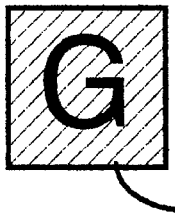
Figure 2I
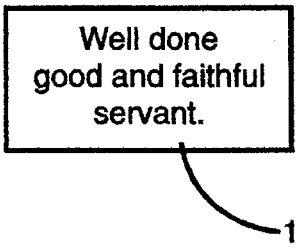
Figure 2J
FIGURES 2A-2J

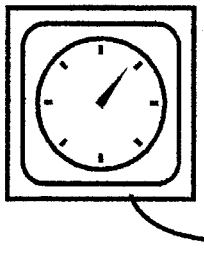
Figure 3A
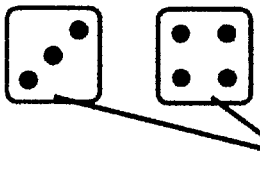
Figure 3B
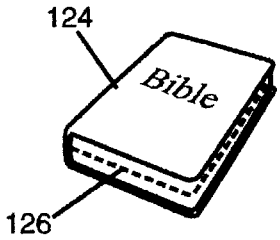
Figure 3C
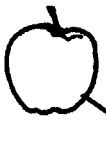
Figure 3D
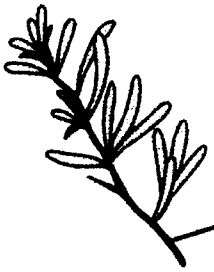
Figure 3E
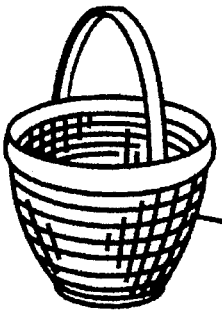
Figure 3F
FIGURES 3A-3F

GOOD NEWS BIBLE BOARD GAME

BACKGROUND OF THE INVENTION

1. Field of the Invention

The present invention relates generally to multi-player board games and more particularly to a multi-player interactive board game especially adapted to effect the instruction of Biblical Christianity through Biblical teachings.

2. Description of the Prior Art

Board games for the instruction of Christian values and Biblical teachings are known in the art of multi-player board games. U.S. Pat. No. 5,377,991 issued to Olsen discloses a Game Method and Apparatus. This game includes a board on which players transit the perimeter according to a certain set of parameters. U.S. Pat. No. 5,071,133 issued to Smith discloses a Board Game for Teaching Biblical Principles. The game includes a board on which players transit the perimeter according to a certain set of parameters. U.S. Pat. No. 5,042,816 issued to Davis et al. discloses a Biblical Question and Answer Board Game. The game includes a board on which players transit the perimeter according to a certain set of parameters.

Thus, while the foregoing body of prior art indicates it to be well known to use a board game to teach Biblical principles, no known game employs the same method of play as the instant invention. The prior art does not teach the use of a unique board playing surface combined with playing pieces shaped as Bibles, the gathering and collecting of objects, the drawing of cards and the use of a timer. Nor does the prior art described above teach or suggest a board game device which may be used by individuals to teach Biblical principles according to the unique method of play provided. The foregoing disadvantages are overcome by the unique rules and gaming components of the present invention as will be made apparent from the following description thereof. Other advantages of the present invention over the prior art also will be rendered evident.

SUMMARY OF THE INVENTION

To achieve the foregoing and other advantages, the present invention, briefly described, provides an instructional board game designed to teach spiritual principles as taught in the Bible. The game is designed to be an interactive multi-player game which includes a board, player tokens, various collectable items, dice, cards and a timer. The board is generally rectangular and may fold, the board further includes a playing surface which has a number of squares and indicia printed thereon. The squares are shaped generally as to form a tree shape and and are centrally located on the board. The squares form rows, there are 14 rows on the playing board. These 14 rows form 7 pairs of rows, the first row pair is located at the bottom of the playing board and the 7th row pair is located at the top of the playing board. The second through sixth row pairs of rows are located intermediate the first row pair and seventh row pair on the playing board. Each of the seven pairs of rows are associated with a "Growth" level. The tree has seven growth levels. They are: Goodness, Knowledge, Self-Control, Perserverence, Godliness, Brotherly Kindness, and Love. Surrounding the tree are eight stacks of cards. Seven of the stacks of cards are associated with the seven aforementioned growth levels. An eighth stack of cards is located near the bottom of the board and is associated with Sin.

A player enters the playing surface through a path. A six sided dice is used which indicates the number of squares that the player may move. The path includes six squares. There are three types of squares on the path. They are "Hard Path", "Rocky Soil" and "Thorny Ground". The player must inevitably land on one of the aforementioned squares. A question is asked the player from a preprinted list which is in some fashion symbolic of the square which the player has landed on. When the player correctly responds, they would roll again in turn.

A player will enter the "Fertile Soil" squares after a certain number of plays. At this point in the player's game life, they become a Christian. At this point their token is separated in half and half of the token is placed in heaven. Heaven is defined as some location off or on the board. The token is in the shape of a Bible and may separate in half. Also, when the player enters the "Fertile Soil" square, his/her name is entered in the "Book of Life".

There are three types of squares a player may land upon during the main course of play. They are a "sin" square, a "growth" square, or a "fruit bearing" square. These squares have identifying indicia located thereon which permits the player to easily identify which square they have landed upon. When a player lands on a "growth" square a playing card from the growth card stack is drawn. The growth card drawn is from the growth card stack associated with the players position on the playing board, specifically which pair of rows the player resides in. The "growth" card includes a question related to the Biblical principle described in the stack. The answer to the question posed is written upside down at the bottom of the growth card. If the question is answered correctly, the player is granted a bonus roll of the dice. There is a maximum of one bonus roll per turn. If the question is answered incorrectly, the correct answer will be read aloud to all players. Each pair of rows is associated with a specific growth level as mentioned above. This arrangement will be more specifically addressed in the detailed description of the drawings.

When a player lands on a "Sin" square a card is drawn from the sin card deck. The sin card details the particulars of a sin committed and hands down a just chastisement, the erring player must move back five squares. Players who may have a variety of sin episodes may only backslide down to the "fertile soil" square.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Bible board game which permits the instruction of Biblical principles in a fun and interactive manner.

It is another object of the present invention to provide a new and improved Bible board Game which may be easily and efficiently manufactured and marketed.

It is a further objective of the present invention to provide a new and improved Bible board game which is of durable and reliable construction.

An even further object of the present invention is to provide a new and improved Bible board game which is susceptible of a low cost of manufacture with regard to both materials and labor, and which accordingly is then susceptible of low prices of sale to the consuming public, thereby making such a Bible board game available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIGS. 2A through 2J describe the different interactive squares that the player will land on during the course of the game.

FIGS. 3A through 3F describe the specific board pieces and devices that will be utilized during the course of the game.

DESCRIPTION OF THE PREFERRED EMBODIMENT

Figure 1:
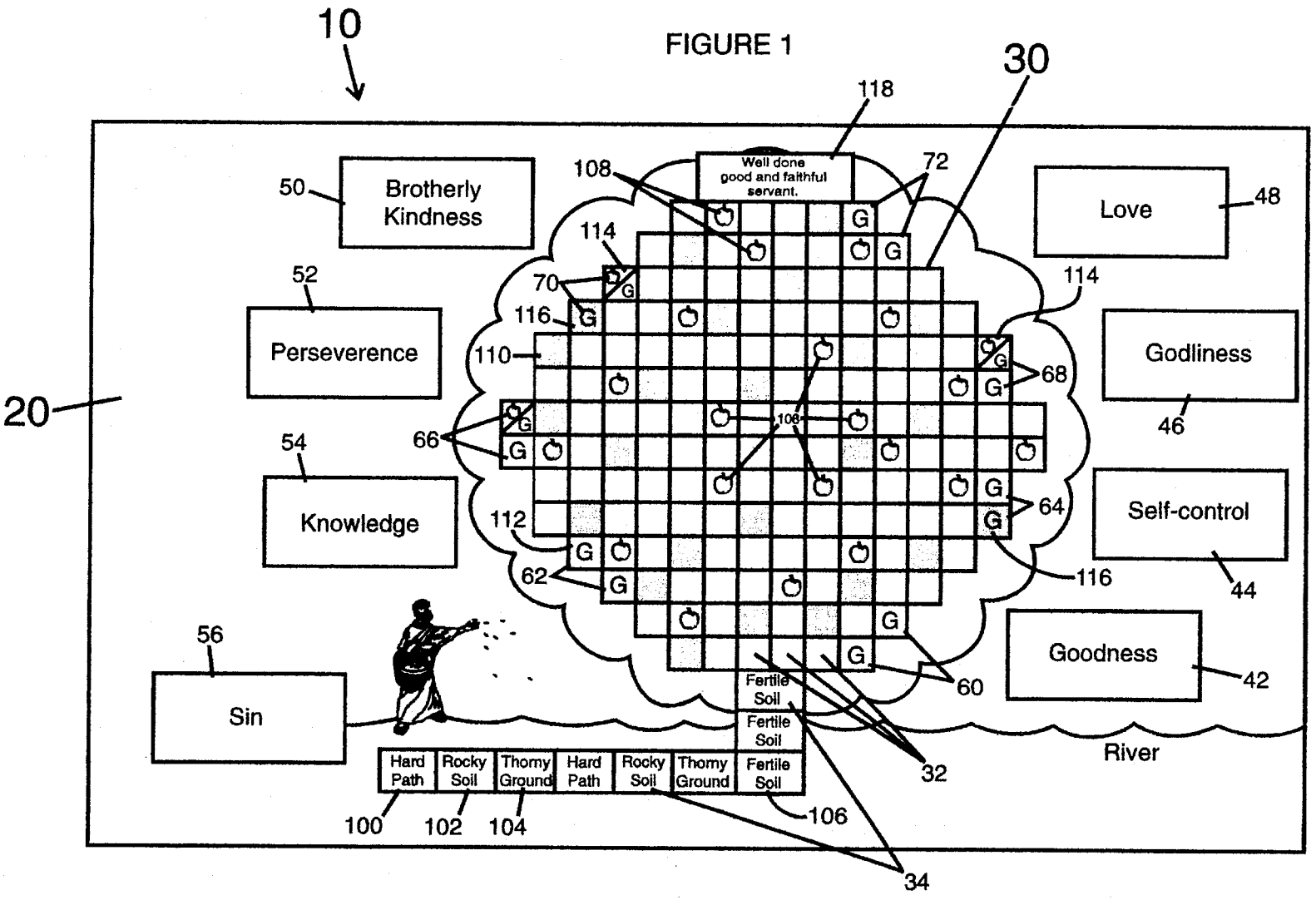
FIG. 1 is a top view showing the general configuration of the playing board of the instant invention.

With reference now to the drawings, a new interactive board game teaching Biblical principles in a fun and thoughtful fashion embodying the principles and concepts of the present invention will be described, Turning initially to FIG. 1, there is shown a first exemplary embodiment of the Good News Bible Board Game of the invention generally designated by reference numeral 10. In its preferred form, the Bible board game 10 comprises a generally rectangular board 20. The board 20 may be constructed of cardboard or other suitable material. The board 20 may include a layer of lamination which has indicia and/or other figures printed thereon. The board 20 includes a centrally disposed playing surface 30. The playing surface 30 includes a variety of squares 32. The squares 32 are generally arranged in rows. The squares 32 generally form a playing surface 30 which is shaped like a tree. The playing surface 30 is entered through a path 34 which would approximate the appearance of a root and trunk of the tree shaped playing surface 30. The tree shaped playing surface 30 has a lower section and an upper section, said lower section proximal the trunk 34 and said upper section proximal the Well Done Good and Faithful Servant Square 118.

Surrounding the tree shaped playing surface 30 is a plurality of rectangles which are designed to have interactive playing cards placed atop their location. These rectangles are associated with different Biblical principles. Goodness 42, Self-Control 44, Godliness 46, Love 48, Brotherly Kindness 50, Perseverance 52, Knowledge 54, and Sin 56 surround the playing surface 30 in a counter-clockwise fashion. When a player lands on a Growth Square in a particular row, the associated interactive card is drawn from the correct deck. A growth square has a "G" designation. This designation is for the purposes of explanation of the course of the game alone, the final designation may be different. Growth squares 60 are associated with Goodness 42. Growth squares 62 are associated with Knowledge 54. Growth squares 64 are associated with Self-Control 44. Growth squares 66 are associated with Perseverance 52. Growth squares 68 are associated with Godliness 46. Growth squares 70 are associated with Brotherly Kindness 50. Growth squares 72 are associated with Love 48. Note how the growth squares 60 are located as the last right squares on the first and second rows. The growth squares 62 are located as the last left squares on the third and fourth rows. The growth squares 64 are located as the last right squares in the fifth and sixth rows. The growth squares 66 are located as the last left squares on the seventh and eight rows. The growth squares 68 are located as the last right squares in the ninth and tenth rows. The growth squares 70 are located as the last left squares in the eleventh and twelveth rows. The growth squares 72 are located as the last right squares on the thirteenth and fourteenth rows. The player will move from right to left on row 1, then from left to right on row two, then from right to left on row three and so on and so forth, alternating the direction of travel at the end of each row.

Referring now specifically to FIGS. 2A through 2J, the interactive squares that a player may land on during the course of play are described. FIG. 2A shows the "Hard Path" square designated 100. This square may be landed on in the earliest part of the game, prior to the player becoming a Christian in gamelife. FIG. 2B shows the "Rocky Soil" square designated 102. This square may be landed on during the earliest part of the game, prior to the player becoming a Christian in gamelife. FIG. 2C shows the "Thorny Ground" square designated 104. This square may also be landed on during the earliest part of the game, prior to the player becoming a Christian in gamelife. When the "Hard Path", "Rocky Soil" or "Thorny Ground" squares are landed on the player must read a sample "life application" symbolic of the type of soil square the player has landed on. FIG. 2D shows the "Fertile Soil" square designated 106. This square is landed on during the early part of play and permits the player to become a Christian during gamelife. FIG. 2F is a "Fruit Bearing" square and is designated 108. When the player lands on this square a fruit icon is gathered by the player. One of the desirable things for a player to do during the course of the game is to gather fruit icons. FIG. 2E is a "Sin" square designated by 110. When the player lands on the "Sin" square 110 during the course of the game a "Sin" card is drawn from the stack of "Sin" cards. The "Sin" cards detail real life situations concerning the avoidance of Sin, the consequences of Sin, and undesirability of Sin. FIG. 2G is a "Growth" square designated 112. "Growth" squares 112 have the letter "G" centrally disposed therein for ease of identification in this disclosure. When a player lands on a "Growth" square 112 an appropriate growth card will be drawn. The final production design may be different in regards to the indicia identifying any of the squares. FIG. 2H is a combination "Growth and Fruit" square designated 114. When a player lands on the "Growth and Fruit" square 114 both a fruit icon and an appropriate growth card will be drawn. FIG. 2J is the "Well Done Good & Faithful Servant" square designated 118. When the player transits the entire length of the board 30 the player's icon will be placed in the "Well Done Good & Faithful Servant" square 118. This is synonymous with the player going to Heaven. The specific interactions between players, movement and specific actions to be taken will become more clear during the discussion of the Rules of Play. It is to be understood that the above mentioned indicia may be changed in the final production game version.

Referring now to FIGS. 3A–3F the specific board pieces and devices are shown. FIG. 3A shows a timer 120. Timer 120 will be utilized during the game to represent Christ's Second Coming. Christ's Second Coming is a Christian belief which coincides with the end of the world where true Christian believers will ascend to Heaven. At the beginning of play, the timer 120 is set to an arbitrary time period. When the timer 120 reaches the preset time, the game ceases.

FIG. 3B shows dice 122. The dice 122 are rolled to determine the number of spaces a player may move during their turn. The dice 122 may also be utilized to determine the order of play. A pair of six sided dice 122 are shown in FIG. 3B. It is to be understood that any device which imparts a random number may be utilized to generate the number of spaces that a player may move. In the preferred embodiment a single six sided die will be employed.

FIG. 3C shows player icon 124. Player icon 124 is shaped in the form of a Bible. The Player icon 124 will come in an assortment of colors in order to differentiate between the different players. During the course of play the player icon 124 may be separated into two parts along line 126. One of these parts will be continued to be utilized as the player icon and the other will demonstrate a Biblical principle which will become apparent during the discussion of the rules of play.

FIG. 3D shows a miniature apple 128. The miniature apple 128 will be awarded to a player whose player icon 124 lands on a "Fruit Bearing" square 108. The collection of miniature apples 128 is a fundamental element of play, the number of miniature apples 128 one has collected is a good measure of how well one is doing in the game in reference to the other players.

FIG. 3E shows a miniature sapling 130. The miniature apples 128 may be traded in for a miniature sapling 130. This describes another Biblical principle which will be more evident during the discourse of the Rules of Play.

FIG. 3F shows a basket 132. Both the miniature apples 128 and the miniature saplings 130 may be collected in the basket 132 during the course of the game. The basket 132 will come in an assortment of colors as well, the player icon 124 may be the same color as the basket 132.

The previous discussion of the game board, elements, and general layout are designed only to put forth one embodiment of the instant invention. Other configurations are possible and will be covered in the scope of the appended claims.

RULES AND METHOD OF PLAY

In order to better understand the disclosed invention, a version of the rules which incorporates the major concepts of the game are presented. It is to be understood that these rules may be modified or changed within the scope of game disclosure.

The first phase of the game is known as "Genesis". In this phase of the game, the players select the player icon 124 (Bible) that they wish to use as their token for the game. The players year of birth determines the order of play. A possible alternative would be utilizing the toss of die 122 to determine the sequence of play. If possible a non-player should set the timer 120 to an undisclosed length of play time and places the timer 124 out of the view of the players. A possible alternative would be the players determining a time period that would be an agreeable time to play.

The intent of the first phase "Genesis" of the game is threefold. First to equate the game's ending with Christ's Second Coming. Second, to drive home the suddenness of Jesus's return as well as it inevitability. Thirdly, to stress the need for the Christian's diligence in their work to focus on their struggle.

The principle which is designed to be imparted to the players during the first phase "Genesis" is that Christ's second coming signals the end of the Christians struggle on Earth and heralds the Judgement which follows. The When (actual time of occurrence of Christ's Second Coming) is known to no one but God (Matthew 24:36/Mark 13:32).

The second phase of the game is known as "The Call". In this phase of the game the players will throw the die 122 to determine the number of squares their player icons 124 will move. The player inevitably lands on either a Hard Path square 100, a Rocky Soil square 102 or a Thorny Ground square 104. The player will read a sample life application determined by which square they reside on.

The intent of the second phase of the game known as "The Call" is twofold. First, to acquaint the player with the parable's symbolisms and interpretation as applied to real life situations. Second, to acquaint the players realization the he/she may have the type of infertile heart of which Jesus speaks.

The principle which is designed to be imparted to the players during the second phase "The Call" is that the Gospel often falls on unreceptive hearts where the devil can easily snatch the message away (Luke 8:12), or on eager but shallow hearts which, once beset by the world's problems and reproach, eventually fall away (Luke 8:13), or on hearts more concerned with the worries of this life and the pursuit of wealth (Luke 8:14).

The third phase of the game is called "Acceptance". The player enters this phase oil: the game when they land on the "Fertile Soil" square 106. The player then reads from a real life application having to do with repentance and acceptance. The player breaks the player icon 124 in half along line 126, placing half the icon in Heaven and half the icon on the Fertile Soil square 106 where he landed. The players name is entered in "The Book of Life". The "Book of Life" is not shown in the Figures, and may be as simple as a sheet of paper for game purposes. However, in the final game design, a more elaborate book of life may be provided.

The principles which are designed to be imparted to the players during the third phase "Acceptance" include highlighting the most important point of the Christian life, repentance and acceptance, by having the player's name entered in the "Book of Life" which assures the player of Salvation. Also, the principle of signifying a conversion, by reading aloud the application as well as reciting a sample acceptance prayer is provided. The third principle put forth in this segment of the game is to help the players realize the significance of the Christian name, that it does not come through birth or religious affinity, but at the point where he or she decides to follow Christ.

The principle which is designed to be imparted to the players during the third phase "Acceptance" is that if anyone accepts Christ into their life, that person becomes a new creation. The old self is gone; a new person has come (2 Corinthians 5:17).

The fourth phase of the game is called "Growth". The growth phase is the main phase of play and essentially includes the player transiting the board 30. The player will move the player icon 124 the number of squares indicated by the toss of the die 122. The player transits the board 30 in a square by square manner in a left to right fashion followed in the next row in a right to left fashion. When the player reaches the rightmost square in any given row, they proceed to the rightmost square in the row immediately above it, and begin traversing that row toward the left. When the player reaches the leftmost square in that row, they proceed to the leftmost square in the row immediately above it, and begin traversing that row toward the right. This zig-zag pattern is maintained throughout the game. The board 30 resembles a tree. The tree has seven growth levels, each growth level is represented by a pair of rows. The seven growth levels are Goodness, Knowledge, Self-Control, Perseverance, Godliness, Brotherly Kindness, and Love. The player icon 124 may land on several types of squares.

One type of square the player icon 124 may land on is a Growth Square 112. When the player lands on a growth square 112 they pick a card from an appropriate growth card stack. Growth squares 60 are associated with goodness growth cards 42. Growth squares 62 are associated with the knowledge growth cards 54. Growth squares 64 are associated with the self-control cards 44. Growth squares 66 are associated with perseverance growth cards 52. Growth squares 68 are associated with Godliness growth cards 46. Growth squares 70 are associated with brotherly kindness growth cards 50. Growth squares 72 are associated with love growth cards 48. The growth card drawn contains a question which the player must answer in order to advance. The correct answer is written upside down at the bottom of each card. If the question is answered correctly, the player is granted a bonus move. There is a maximum of one bonus roll per turn. If the player answers the question incorrectly, the player must remain on that growth square until the player answers the question correctly. There will be no roll of the die on the players next move, he merely picks the next card. All questions are read aloud, and if answered incorrectly, the correct answer is read aloud to edify all players.

The intent of the growth square 112 is manyfold. First, the intent is to educate players on sound Biblical principles and to reinforce through repetition the same principle through the creative structuring of the same question in different ways. Second, to build in topical studies by using different growth areas. Third, to concretely express the basic truth that one cannot grow as a Christian unless one is familiar with God's Word.

The principle which is designed to be imparted to the player by landing on the growth square includes that those who choose to follow Christ are slowly being transformed to becoming more like Him (2 Cor, 3:18). Also, that by possessing these Christlike qualities in increasing measure (2 Peter 1: 5–8) they escape the world's corruption and render the head-knowledge of Christ into one that is active and productive.

Another type of square the player icon 124 may land on is a Sin square 110. When the player lands on a sin square 110 they pick a card from the Sin card stack 56. The sin card details the occasion of sin and hands down just chastisement, that is specifically that the erring player moves back 5 spaces.

The intent of the sin square 110 is to illustrate the occasions of sin by using present day examples from the most blatant transgressions (murder, theft) to the subtlest (white lies, gossip). To stress that in God's eyes, sin is sin regardless of its nature or severity. Another intent is to instill in the player a conscious aversion to sin, the player will detest landing on the sin square. Other intents include to educate the player that succumbing to Sin hinders growth and blocks the Christians goal of pleasing God, as well as to educate the player on the different sources of sin: self, the world's system and Satan.

The principles behind the sin square 110 are as follows. Sin strains our fellowship with God because he cannot tolerate it. (Isaiah 59:1–2). He considers all sin equal in deserving punishment (Romans 3:23/James 2:10) and judges each one fairly (1 Cor 3:13–15). However, for the Christian, sin may hinder this fellowship but does not sever it. All the Christian needs to do is admit the sin, repent and draw back to God, who is always ready to forgive.

Another type of square that the player icon 124 may land on is the Fruit Bearing Square 108. When a player lands on a fruit bearing square 108 the player harvests one fruit (miniature apple) 128 and places it in the basket 132. As the game progresses and the player is able to harvest more fruits the player may trade in 5 fruits 128 for one sapling 130. No bonus turn is granted for landing on a fruit bearing square 108 as the players reward shall be in heaven.

The intent of the fruit bearing square 108 is to graphically illustrate the fruit bearing aspect of Christian life. Each fruit represents a person the player has shared with who repented and accepted Christ into their life. Another intent is to exemplify the discipleship process, that is, only 1 in 5 fertile hearts will probably grow to fruit bearing maturity. Also, the intent of the fruit bearing square 108 is to generate as much excitement in the sharing process as possible by having the player (Christian) desire to harvest as much fruit 128 as possible.

The principle behind the fruit bearing square 108 is that Christ has given the Christians the Great Commission; to go and make disciples of all the nations (Matthew 28:18–20). As one whose fertile heart the Gospel's seed had been planted, we are to eagerly look forward to bearing fruit, thirty, sixty, and even a hundredfold (Matthew 13:23).

The fifth phase of the game is called "Eternal Life". The eternal life phase is the final phase of play and essentially determines how the game ends. The game can end in two ways. First, the player reaches the last square at the top of the board 30. The game ends for that player, the other players continue to play. Secondly, the timer 120 sounds. The sound of the timer 120 heralds Christ's Second Coming. It marks the end of the game for all players. All players take inventory of their fruits and saplings and look forward to a blissful eternal life with God Almighty.

The intent of the eternal life phase is to teach the joy of having persevered, by God's grace, having been strengthened by His word. Also, to explain man's purpose in this world, specifically to please and serve the Lord. Another intent is to instill the certainty of Christ's Second Coming and the uncertainty of when it shall be.

The principles behind the eternal life phase are that we all strive to have efforts and intentions appreciated. What better acknowledgement is there that to hear God say, "Well done, Good and Faithful servant" (Matthew 25:21). This marks the culmination of the Christian's odyssey on Earth-whether it comes through physical death (Heb. 9:27) or when caught up in the clouds with Christ at His return (1 Thes 4:16–17). This too marks the start of eternity. Eternal life for those who confess that Jesus is their personal Lord and Savior (1 John 5:11–13); and eternal damnation for those who chose not to heed (Revelation 21:8).

There are several Miscellaneous Provisions of the game. For a faster game the following strategies may be employed. First, there may be no limit to the number of bonus rolls a Christian can garner and the player correctly answers questions posed. Their turn will end when the player can no longer successfully answer the questions posed. Secondly, when landing on a fruit bearing square 108, the player will be permitted one bonus turn.

A square is provided for fruit bearing combined with a growth square (FIG. 2H) 114. These are the growth squares combined with a fruit symbol. When a player lands on this square, the player reaps one bonus fruit if the question is answered correctly. An unacceptable answer voids the bonus.

If a player has a series of Sin encounters, ie: the player keeps landing on Sin squares 110, the player may only backslide to the Fertile Soil squares 106. When this happens the player picks from a special deck of cards known as the "Salvation Check" stack. The cards will ask the sinful player a question derived from key evangelism verses. Erring player will be restored if a correct answer is given by the awarding of a bonus roll. Erring player will neither regress or progress should answers to the questions be unacceptable. The player merely waits till the next turn and tries again.

The intent of the cascading sin encounter is to teach that one cannot loose their Salvation once it has been given to him by God. Also, it checks the players salvation through the review of key evangelism principles and verses. The reinforcement of one's acceptance by fellow Christians through the symbolic process of restoration is also provided. And perhaps the key intent of the cascading sin encounter is to symbolize the sad state of a Christian unfamiliar with God's words as this Christian leads an unproductive life for Christ.

The principles behind the cascading sin encounter as simply that Jesus promises to never reject those who turn to Him because it is God's will that He should not even lose one who is given to Him (John 6:37–40). However, this promise applies only to those who really belong to Christ, not all who cry "Lord!!—Lord!!" will enter the kingdom of Heaven (Matthew 7:21).

It is apparent from the above that the present invention accomplishes all of the objectives set forth by providing a new and improved Bible board game which permits the instruction of Biblical principles in a fun and interactive manner, which may be easily and efficiently manufactured and marketed, and is of durable and reliable construction.

With respect to the above description, it should be realized that the optimum dimensional relationships for the pads of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A Bible board game for the instruction of Biblical principles in a competitive and exciting manner, the board game comprising:

a gameboard, said gameboard being generally rectangular and having a central tree shaped portion disposed centrally thereon, said tree shaped portion including a plurality of parallel rows of squares defining a plurality of pair of rows of squares, wherein the two rows in each in each of said pairs of rows are adjacent to one another, said squares defining a path, said path enabling each player to sequentially move towards a goal square, said tree shaped portion having a lower section and an upper section, said goal square disposed about said upper section, a selected number of squares in said path having distinguishable indicia designating growth squares, fruit bearing squares and sin squares, each pair of rows having at least one growth square thereon, a plurality of tokens, with a token provided to each player to serve as a marker on said gameboard indicative of the progress of each player on said gameboard, a plurality of basket, with a basket provided to each player to serve as a device to gather a first type of game pieces which are disposed on said fruit bearing squares, a random number generating device, said random number generating device to determine the number of said squares each player will move per turn, a plurality of decks of cards, each deck of cards representing a different topic on Biblical principles including sin, said plurality of decks of cards disposed about said central tree shaped portion, said game board having a plurality of rectangles disposed about said central tree shaped portion, wherein each pair of rows having one of said rectangles aligned and parallel therewith, each of said plurality of rectangles having indicia representing one of said different topics on Biblical principles wherein said plurality of decks of cards representing different topics of Biblical principles are correspondingly placed on said plurality of rectangles, said plurality of decks of cards having Biblical questions located thereon, said plurality of decks of cards associated with said growth squares and said sin squares, whereby the players move on said path and upon landing on a growth square, the players sequentially pick a card from one of said plurality of decks of cards which is placed on a rectangle that is aligned and parallel to said pair of rows said growth square is on, and attempt to correctly answer the question posed, or upon landing on a sin square, the players sequentially pick a card from said deck of cards representing sin and attempt to correctly answer the question posed, or upon landing on a fruit bearing square the players gather said first type of game pieces disposed thereon and places said first type of game pieces in said basket, wherein said player who gathers the most of said first type of game pieces during said game being declared the winner.

2. The Bible board game as claimed in claim 1 wherein said path has a first portion, said first portion approximates a trunk of said central tree shaped portion, said trunk including hard path squares, rocky soil squares, thorny ground squares and fertile soil squares whereby said players must answer a question posed when they land thereon, and further, when the players lands on the fertile soil square, upon correctly answering the question posed, will have their name entered in a Book of Life.

3. The Bible board game as claimed in claim 2 including a timer, said timer set to a random time period which is the duration of the game.

4. The Bible board game as claimed in claim 3 including a second type of game pieces, whereby a first number of said first type of game pieces may be traded in for said second type of game pieces.

5. The Bible board game as claimed in claim 4 wherein said random number generating device is a six sided die.

6. The Bible board game as claimed in claim 5 wherein said first type of game pieces are generally shaped as a fruit.

7. The Bible board game as claimed in claim 6 wherein said fruit may be chosen to shaped as an apple.

8. The Bible board game as claimed in claim 5 wherein said first number is less than 10.

9. The Bible board game as claimed in claim 8 wherein said second type of game pieces are generally shaped as a sapling.

10. The Bible board game as claimed in claim 1 wherein said plurality of rows includes 14 rows, said 14 rows defining 7 pair of rows.

11. The Bible board game as claimed in claim 1 wherein said token may be in the shape of a Bible.

12. The Bible board game as claimed in claim 11 wherein said token is separable into a first section and a second section, said first section remains on said gameboard and said second section placed in a second location, said second location symbolizing Heaven.

* * * * *